United States Patent [19]

Morrison et al.

[11] 4,069,697

[45] Jan. 24, 1978

[54] AUTOMATIC COUNTERBALANCE CONTROL CIRCUIT

[75] Inventors: James J. Morrison, Windsor, Canada; Berlyn E. Baringer, West Bloomfield, Mich.

[73] Assignee: Kasel Steel Corporation, Detroit, Mich.

[21] Appl. No.: 740,518

[22] Filed: Nov. 10, 1976

[51] Int. Cl.[2] ..... B21J 9/20

[52] U.S. Cl. ..... 72/19; 72/436; 72/445; 72/450

[58] Field of Search ..... 72/19, 436, 437, 445, 72/450; 100/231, 43, 282

[56] References Cited

U.S. PATENT DOCUMENTS

| | | | |
|---|---|---|---|
| 1,562,988 | 11/1925 | Nelson | 72/437 |
| 2,084,066 | 6/1937 | Rode | 72/450 |
| 2,767,601 | 10/1956 | Reed | 72/445 |
| 2,970,327 | 2/1961 | Friedman | 72/450 |
| 3,557,600 | 1/1971 | Saito | 72/450 |
| 3,561,252 | 2/1971 | Norton | 100/231 |
| 3,834,216 | 9/1974 | Schiller | 72/450 |

FOREIGN PATENT DOCUMENTS

| | | | |
|---|---|---|---|
| 1,390,729 | 1/1965 | France | 72/436 |

*Primary Examiner*—C.W. Lanham
*Assistant Examiner*—Gene P. Crosby
*Attorney, Agent, or Firm*—Cullen, Settle, Sloman & Cantor

[57] ABSTRACT

A control circuit for automatically counterbalancing the moving components of a mechanical power press. The counterbalance circuit is responsive to the current drawn by the press motor to regulate air pressure in a cylinder attached to the press ram. On the press downstroke, air pressure in the cylinder is decreased only if the press is over counterbalanced and on the press upstroke, air pressure in the cylinder is increased only if the press is under counterbalanced.

5 Claims, 4 Drawing Figures

AUTOMATIC COUNTERBALANCE CONTROL CIRCUIT

BACKGROUND OF THE INVENTION

The present invention is directed to a control circuit for automatically counterbalancing the moving components of a press.

It is well known that in a machine such as a press, it is necessary to keep the moving components in equilibrium by using air pressure to counterbalance the moving members on the eccentric such as a reciprocable ram having a die half mounted thereon. More specifically, in the operation of such a press, on the downstroke if there is excess counterbalancing then the press does more work than necessary causing excess wear on the moving parts, e.g., the flywheel, cam, etc. Similarly, on the upstroke of the ram, if there is insufficient counterbalancing, then the working members tend to fall away from the eccentric as the flywheel energy is restored.

Since each die used on a press has its specific configuration and weight, a change is required in the counterbalance to maintain equilibrium each time a different die is placed on the press.

In addition, in a variable speed press, the counterbalancing is a function of not only the die weight on the ram but also of the ram speed.

Under state and federal safety and health acts (for example, OSHA), it is necessary to identify the weight of a die on the upper half of the die and thereafter train operators to set the air pressure for counterbalancing. However, this does not account for various speeds of operation of the press.

SUMMARY OF THE INVENTION

The present invention is directed to a circuit for automatically counterbalancing the moving components of a press. It is, of course, conventional to counterbalance a press with air pressure by providing an air cylinder on the reciprocable ram of the press and manually presetting the air pressure in the cylinder to maintain the moving components of the press in equilibrium.

The present invention is directed to an electrical circuit for automatically regulating air pressure in the cylinder to thus maintain proper air pressure for counterbalancing the press at various die weights on the ram and at various press speeds.

The present invention detects variations in the current drawn by the press motor and changes the air pressure in the cylinder to counterbalance the press based upon these variations in current. This is based upon the principle that the current will increase on the downstroke if there is excess counterbalancing, because the press works harder, and will increase on the upstroke if there is insufficient counterbalancing, again because the press works harder.

Hence, the present invention monitors the current drawn by the press motor, detects the direction of the press stroke, i.e., upstroke or downstroke, and then increases or decreases the counterbalancing pressure, as appropriate, based upon variations in the press motor current.

BRIEF DESCRIPTION OF THE DRAWINGS

The various objects and advantages of the present invention will become more apparent upon reading the following detailed description taken in conjunction with the drawings.

In the drawings, wherein like reference numerals identify corresponding components.

DETAILED DESCRIPTION OF THE INVENTION

Figure 1:
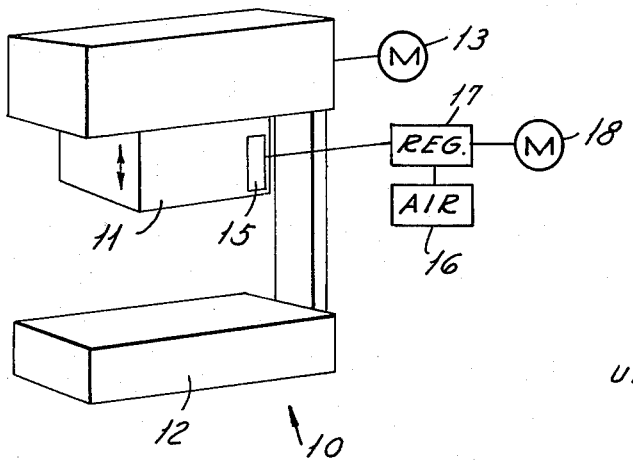
FIG. 1 is a partial perspective, partial schematic representation of a press which is to be counterbalanced by the circuit of the present invention.

The present invention has a particular utility in automatically counterbalancing the moving components of a press 10 having a reciprocable ram 11 and a stationary bed 12. Upper and lower die halves are placed upon the ram and bed, respectively, as is conventional, and the speed of the ram is controlled by an electric motor 13.

Positioned on the ram 11 is a pneumatic cylinder 15 to which a supply of air 16 may be introduced such as through a regulator 17. The regulator 17 is controlled by a small bidirectional electric motor 18; driving the motor in the first direction increases air in the cylinder and driving the motor in the opposite direction permits air to be bled from the cylinder.

Figure 2:
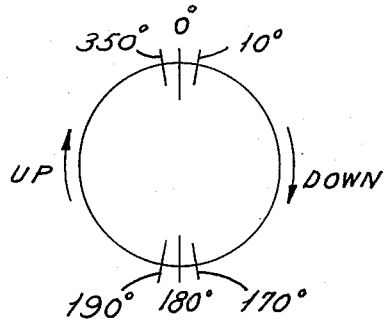
FIG. 2 is a diagrammatic illustration for detecting the direction of the press stroke.

FIG. 2 illustrates, schematically, the operation of a press cycle relative to a cam or eccentric, starting at 0°. The interval from zero degrees to 180°, proceeding clockwise, corresponds to the downstroke of the press and interval between 180° and 360°, proceeding clockwise, corresponds to the upstroke of the press.

According to the principles of the present invention, the interval between 350° and 10° may be ignored in counterbalancing the press and the interval between 170° and 190° may likewise be ignored.

Figure 3:
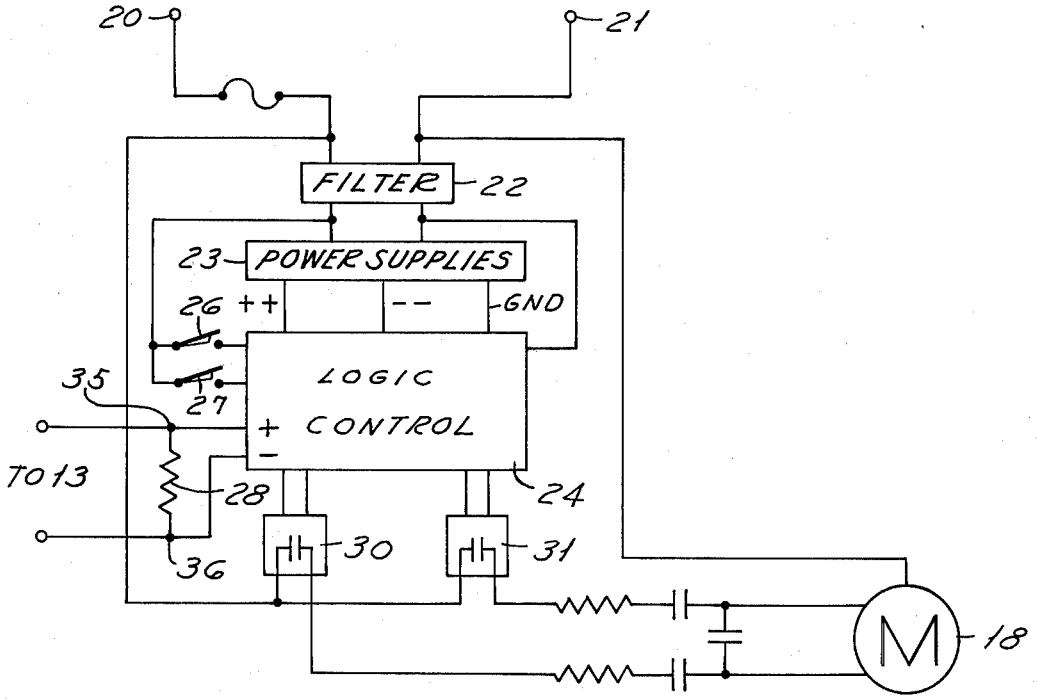
FIG. 3 is an electrical block diagram of the counterbalancing control circuit of the present invention.

FIG. 3 illustrates, generally, a schematic circuit for counterbalancing the press according to the principles of the present invention. The circuit receives alternating current between terminals 20 and 21 from the transformer which supplies power to the press motor 13. Typically, this would be a 60 hertz 110 volt signal.

The alternating current signal is filtered, by filter 22, and this filtered signal serves as the input to the power supplies 23. The power supplies provide the input power to the logic control circuit 24.

The filtered alternating current signal is also connected to first and second rotary limit switches 26, 27, each of which are attached to the eccentric. The first rotary switch 26 is closed by the eccentric during the press cycle from 10° to 170° and hence is closed during the downstroke of the ram. The second rotary limit switch 27 is closed by the eccentric during the interval from 190° to 350° and thus is closed during the upstroke of the ram. The output of each of the rotary limit switches 26, 27, is provided to the logic control 24.

In order to determine the current drawn by the press motor, a shunt 28 is connected across the press motor 13 and a voltmeter (not illustrated) may be utilized to determine the voltage drop across the shunt 28. Since shunt 28 will be of a known value, the current drawn by the motor 13 may thus be determined and is input to the logic control circuit 24.

The output from the logic control circuit 24 is provided to first and second solid state relays 30, 31. Relay 30, when energized, enables motor 18 to be driven in a forward direction to increase the air pressure in cylinder 15. Relay 31, when energized, enables the motor 18 to be driven in the reverse direction to decrease air pressure from the cylinder 15.

The details of the electrical circuit of the present invention will now be explained. In essence, the present circuit includes a first portion, to detect press motor current deviations above a preselected threshold, and first and second parallel logic path portions. The first logic path is closed, or enabled, only during the 10 to 170° interval of the press downstroke and the second logic path is closed, or enabled, only during the 190 to 350° interval of the upstroke. The outputs of the parallel logic paths and the threshold detection portion are supplied to memory which energizes the appropriate relay to control bidirectional motor 18.

Figure 4:
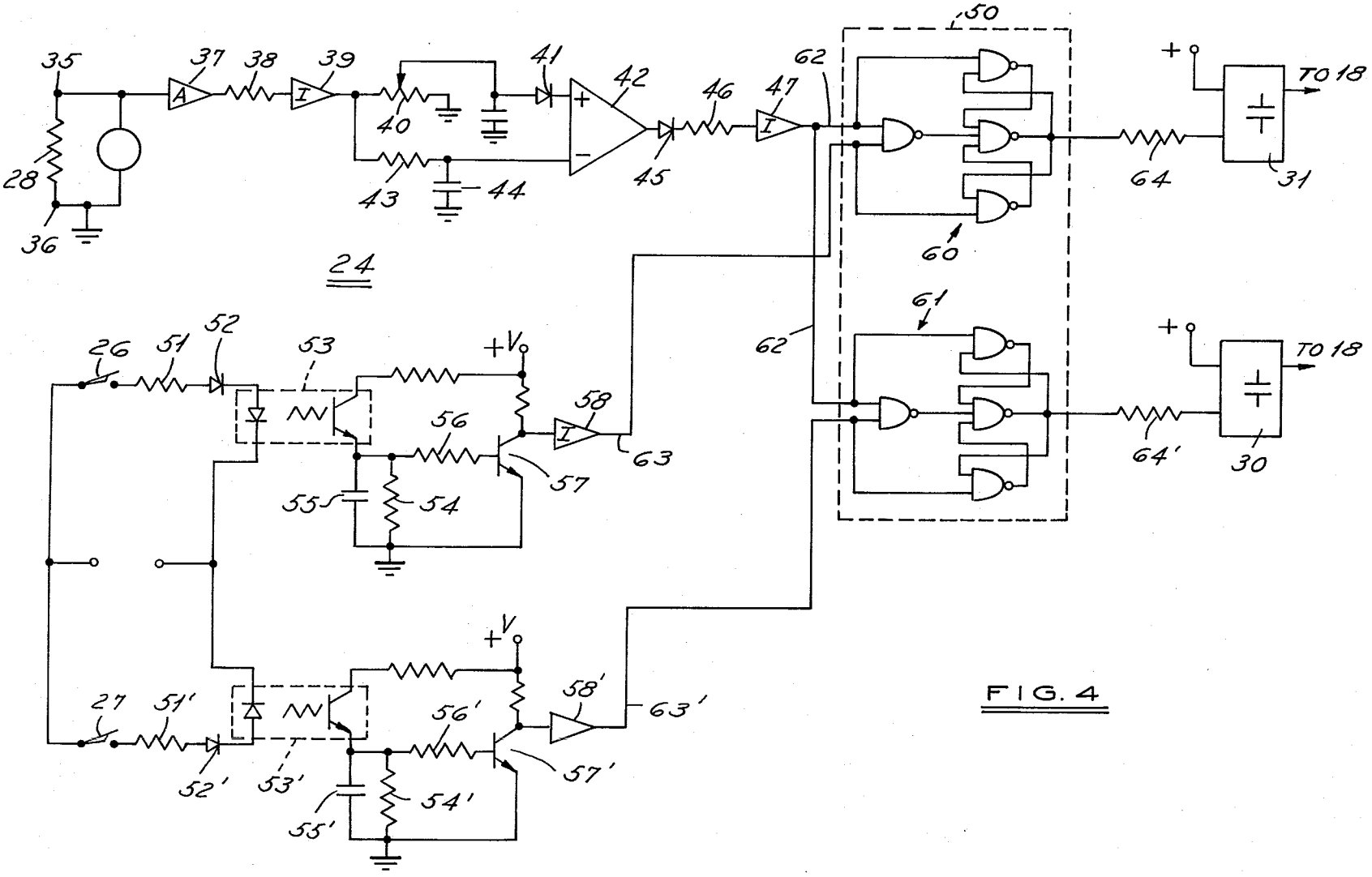
FIG. 4 is a more detailed circuit schematic for the counterbalancing control circuit of the present invention.

With reference to FIG. 4, the current through the shunt 28, taken between terminals 35 and 36, is utilized as an input to an amplifier 37. The output from the amplifier 37 is coupled through a resistor 38 to an inverter 39. The output from inverter 39 is connected through a potentiometer 40 and through a diode 41 to the positive input of a comparator 42. The output from inverter 39 also passes, along a separate path, through a resistor 43 and a capacitor 44, coupled as an RC delay circuit, and thence to the negative input of the comparator 42. One side of capacitor 44 is coupled to the resistor 43 and the other side of capacitor 44 is grounded as is conventional.

The difference between the two inputs to the comparator 42 is utilized to detect current variations of the press motor 13 relative to a threshold. Thus, this portion of the circuit serves as a threshold detector and adjustment of the potentiometer 40 establishes the minimum current deviation necessary to actuate automatic counterbalancing.

For smaller current deviations, i.e., deviations below the adjustable threshold, there will be no automatic counterbalancing because these deviations are normal, of short duration, and may be ignored. In a typical environment, a current change of less than 10 amperes may be ignored.

Current variations in eccess of ten amperes will be utilized to effect automatic counterbalancing. However, if desired, potentiometer 40 may be manually adjusted so that the threshold detector portion of this circuit does not provide counterbalancing for current deviations below 25 amperes.

The output from the comparator 42 is coupled through a diode 45 and a resistor 46 to an inverter 47. The output of the inverter 47 is connected to a memory 50 as will be more fully described.

In order to determine whether to increase or decrease the air pressure in the cylinder, it is necessary to determine whether we are on the upstroke or the downstroke of the press.

To accomplish this, the first rotary limit switch 26, which is closed between 10° and 170°, i.e., during the downstroke, receives an incoming electrical alternating current signal as illustrated in FIGS. 3 and 4. When the rotary limit switch 26 is closed, this alternating current signal is passed through a resistor 51 and a diode 52 to a phototransistor 53. The output from the emitter of the phototransistor 53 is coupled across a parallel RC circuit of resistor 54 and capacitor 55 and then through a resistor 56 to the base of a transistor 57. The output from the transistor 57 is taken from the collector, through an inverter 58 to the memory 50.

Prior to the closing of the rotary limit switch 26 phototransistor 53 is off. Hence, there is low base current to the transistor 57. Transistor 57 is off and the collector potential of transistor 57 is high, thus providing a high input to the inverter 58 and a low, or zero output from the invertor 58 to the memory.

Once the rotary limit switch 26 is closed, phototransistor 53 switches on and this provides a high signal to the base of transistor 57 causing transistor 57 to turn on. Thus the collector potential of transistor 57 is low and hence the output of the inverter 58 goes to a high or one state.

The portion of the circuit connected to rotary limit switch 27 includes the same components as those just described with reference to the circuit connected to rotary limit switch 26. Hence, they are indicated with a prime, e.g., a phototransistor 53', a transistor 57' and an inverter 58'. This portion of the circuit operates in the identical fashion as the portion of the circuit operating with respect to rotary limit switch 26.

The memory 50 of the present invention includes a pair of digital differential line receivers 60, 61. Each digital differential line receiver, or DDLR, receives, as one input, the output from inverter 47 associated with the threshold detection portion of this circuit, along lead 62. DDLR 60 also receives the output from inverter 58 associated with the rotary limit switch 26 along lead 63.

The truth table for the DDLR indicates that the output will be high except when the input on lead 62 is low and the input on lead 63 is high, in which case there will be a low output from the DDLR 60.

The output from the DDLR 60 is coupled through a resistor 64 to the negative terminal of the solid state relay 31.

The operation of this DDLR in conjunction with the solid state relay 31 will now be explained. During the downstroke of the press, and specifically during the first 10 degrees of the downstroke, rotary limit switch 26 is open and the output of the inverter 58 is zero. A zero input along lead 63 to the DDLR 60 provides a high output from the DDLR and hence relay 31 is not energized. During the next portion of the downstroke, from 10° to 170°, the rotary limit switch 26 is closed, the output from inverter 58 along lead 63 is high, and the DDLR 60 is enabled depending upon the input on lead 62.

Prior to a current deviation in excess of the threshold, the output of comparator 42 is low and this signal is inverted by inverter 47 to provide a high input along lead 62. The combination of a high or one input on lead 62 and a high input on lead 63 does not, according to the truth table, cause the output of the DDLR to go low.

As soon as the motor current deviates above the threshold, the output of comparator 42 goes high causing the output of inverter 47 to go low along lead 62. The combination of a low or zero input on lead 62 and a one or high input on lead 63 causes the DDLR output to go low. The low signal, through resistor 64 to the ground input of the solid state relay 31, energizes the relay and causes the contacts of the relay to close thus permitting the motor which regulates the air in the cylinder to be driven. As indicated in FIG. 3, energization of the relay 31 causes the motor 18 to be driven in a reverse direction to bleed air from the air cylinder.

This is because a current deviation on the downstroke indicates excess counterbalancing which should be controlled by bleeding air from the air cylinder.

During the interval from 170 degrees until ten degrees, rotary limit switch 26 again opens, the output from inverter 58 along lead 63 again goes low and, according to the truth table, the output of DDLR again goes high and remains high regardless of the signal on lead 62. The output of the DDLR 60 being high precludes closing the contacts of the solid state relay 31.

The memory 50 includes a second DDLR 61 which operates on the same truth table and thus has a low output only when the inputs are zero and one, respectively, referring to the inputs from the threshold deviation circuit on lead 62 and from the inverter 58' on lead 63'. From the press cycle of 350° until 190°, rotary limit switch 27 is open, the output from inverter 58' along lead 63' is low through the DDLR 61 and the output of the DDLR 61 is high regardless of the input along lead 62. This high output from the DDLR 61 through a resistor 64' to the ground input of the solid state relay 30, prevents the energization of solid state relay 30. Thus, contacts of solid state relay 31 remain open and the motor 18 is not energized.

During the portion of the press cycle between 190° and 350°, rotary limit switch 27 is closed, the output from inverter 58' goes high along lead 63' and DDLR 61 is enabled to energize the relay 30 if the second input along lead 62 goes low.

Again, the operation of the threshold detector portion of the circuit, to respond to current deviations, is the same. Should the current deviation exceed the threshold, the output from inverter 47 goes low, providing a low signal along lead 62, taking together with the high input on lead 63' causes the DDLR 61 to have a low output according to the truth table. This low output is passed through resistor 64 to the ground terminal of the solid state relay 30 which energizes the solid state relay 30, causes the contacts of the relay 30 to close and thus drives the motor 18 forward.

Summarizing the circuit operation in the context of the operation of the counterbalancing control, on the downstroke of the press, when the current drawn by the motor 13 deviates above the threshold, there is excess counterbalancing. To automatically compensate for this excess counterbalancing, it is necessary to reverse the direction of the bidirectional motor 18 and to bleed air from the cylinder 15. Thus, when the contacts of relay 31 are closed, indicating a deviation in press motor current above the threshold and rotary limit switch 26 closed, motor 18 is driven in a reverse direction to operate regulator 17 to bleed air from the cylinder 15 and compensate from the overbalanced condition.

Similarly, on the upstroke, when the current drawn by the press motor 13 deviates above the threshold, there is insufficient counterbalancing. To automatically compensate for this, then with rotary limit switch 27 closed, the contacts of relay 30 are closed permitting the motor 18 to be driven in a forward direction to increase the air pressure in the cylinder 15 through the regulator 17.

The foregoing is a complete description of the circuit for providing a motor controlled regulator to regulate air pressure in a piston attached to the ram of a press as a function of press motor current deviations. On the downstroke, when press motor current increases, there is too much counterbalancing and air is bled off from the cylinder. On the upstroke, when the press motor current increases, there is insufficient counterbalancing so more air is added to the cylinder. The converse conditions, i.e., insufficient counterbalancing on the downstroke and excess counterbalancing on the upstroke, may both be ignored.

It may be appreciated that various changes and modifications to the circuit of the present invention may be made without departing from the spirit and scope of the present invention. The invention, therefore, should be limited only by the scope of the following claims:

What is claimed is:

1. In a press operated by an electric motor having up and down strokes as is conventional and an air operated cylinder for automatically counterbalancing the press by regulating the air in the cylinder the improvement comprising:

switch means to differentiate between the upstroke of the press and the downstroke of the press;

means to detect changes in the current of the press motor; and means to increase counterbalancing only if the press is under counterbalanced on the upstroke and to decrease counterbalancing only if the press is over counterbalanced on the downstroke.

2. The invention as defined in claim 1 wherein said switch means includes a pair of rotary limit switches, one of said rotary limit switches being closed only during the downstroke and the other being closed only during the upstroke of the press.

3. The invention as defined in claim 1 and further including a threshold detector to respond to current deviations of said press motor only in excess of a predetermined amount.

4. The invention as defined in claim 1 and further including a bidirectional motor to regulate air pressure in the cylinder by increasing or decreasing air pressure in the cylinder based upon the direction of bidirectional motor rotation.

5. The invention as defined in claim 1 wherein said circuit includes first and second parallel logic paths, said first logic path enabled on the downstroke of the press and said second logic path enabled on the upstroke of the press, each of said logic paths, when enabled, for signaling a change in motor current above a predetermined threshold for increasing or decreasing the counterbalance respectively.

* * * * *